US005549124A

United States Patent [19]

Dorsey

[11] Patent Number: 5,549,124

[45] Date of Patent: Aug. 27, 1996

[54] WATER FILTER FOR CIGARETTES

[76] Inventor: David A. Dorsey, 2223 Alaulau St., Pearl City, Hi. 96782

[21] Appl. No.: 206,888

[22] Filed: Aug. 29, 1988

[51] Int. Cl.[6] ..... A24D 3/04

[52] U.S. Cl. ..... 131/337; 131/335

[58] Field of Search ..... 131/331, 335, 131/337

[56] References Cited

U.S. PATENT DOCUMENTS 2,796,869 6/1957 Gerard et al. .
2,911,984 11/1959 Gerhard et al. .
3,366,121 1/1968 Carty ..... 121/337
3,416,541 12/1968 Hoover .
3,884,246 5/1975 Walker ..... 131/337
4,003,387 1/1977 Goldstein .

*Primary Examiner*—Jennifer Bahr
*Attorney, Agent, or Firm*—George W. T. Loo

[57] ABSTRACT

A water filter for cigarettes wherein water in a frangible capsule is released and dampens the tobacco. This dampened tobacco helps filter the tobacco smoke being sucked through the cigarette.

1 Claim, 1 Drawing Sheet

WATER FILTER FOR CIGARETTES

The invention relates to filter elements and particularly to an improved water filter for cigarettes. The filter element of this invention contains a frangible or collapsible module having contained therein a liquid such as distilled water. The water is dispersed into the tobacco portion of the cigarette. Thus wetting or dampening the tobacco. The wet tobacco then acts as a filter for tobacco smoke generated and sucked through the cigarette.

DETAILED DESCRIPTION OF THE DRAWING

Figure 1:
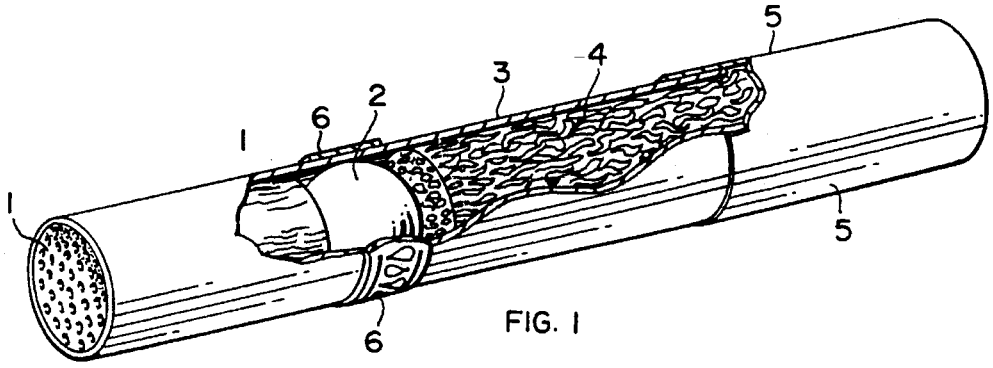
FIG. 1 is a perspective new of a cigarette having an embodiment of the filter element of this invention.
Figure 2:
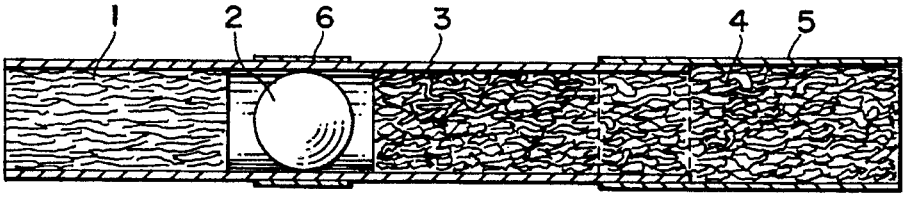
FIG. 2 is a cross-sectional view of FIG. 1

FIGS. 1 and 2 illustrates the water filter of this invention in a cigarette: Frangible or crushable capsule 2 contains a liquid such as distilled water. Capsule 2 is embedded in a resilient reinforcing sleeve 3 of heavy cigarette paper. Crush band 6 has indicia printed thereon indicating where pressure must be exerted on capsule 2 so as to release the water into tobacco charge 4. At the lighting end the cigarette has sleeve 5 wrapped about sleeve 3 in a telescopic relationship, as illustrated. The mouthpiece 1 is filled with an absorbent material such as cellulose or other material.

Figure 3:
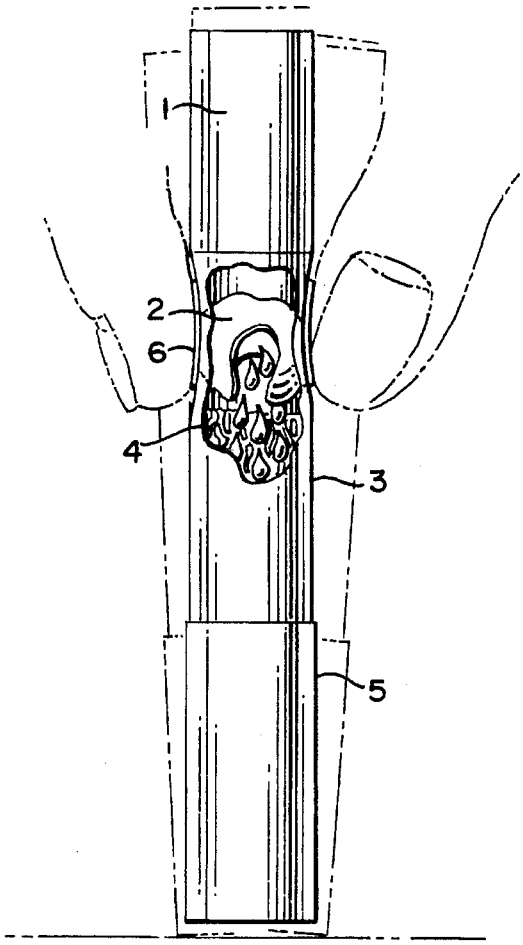
FIG. 3 illustrate the release of water into the tobacco portion of the cigarette.

FIG. 3 illustrates the crushing of the capsule 2 and the tapping of the cigarette portion 5 on a hard surface. This tapping will cause the water to be dispersed in the tobacco.

What is claimed and desired to be secured by United States Letters Patent is:

1. A cigarette comprising a first cylindrical tube containing at one end an absorbent material in said tube adapted to serve as a mouthpiece; said tube at its other end containing a cylindrical charge of tobacco in said tube; said mouthpiece and said absorbent material being separated by a space therebetween; said space containing a liquid containing crushable capsule; said capsule being located in said tube; on the exterior of said tube and located over said capsule is positioned a band with indicia thereon indicating the location of said capsule in said tube; at the end of said tube containing said tobacco a cylinder of cigarette paper being telescopically fitted over said tobacco containing end and extending beyond said end containing said tobacco; said cylinder containing tobacco.

* * * * *